US009938703B2

(12) United States Patent
Wu et al.

(10) Patent No.: US 9,938,703 B2
(45) Date of Patent: Apr. 10, 2018

(54) TOILET TANK DRIVE VALVE DEVICE BASED ON CAPACITIVE SENSING

(71) Applicants: Dong Peng, Xiamen (CN); Xingyi Yu, Xiamen (CN)

(72) Inventors: Guoqiang Wu, Xiamen (CN); Zhenyu Dai, Xiamen (CN)

(73) Assignees: Dong Peng, Xiamen (CN); Xingyi Yu, Xiamen (CN)

( * ) Notice: Subject to any disclaimer, the term of this patent is extended or adjusted under 35 U.S.C. 154(b) by 86 days.

(21) Appl. No.: 15/138,233

(22) Filed: Apr. 26, 2016

(65) Prior Publication Data

US 2016/0312453 A1 Oct. 27, 2016

(30) Foreign Application Priority Data

Apr. 27, 2015 (CN) ..... 2015 1 0204436

(51) Int. Cl.
*E03D 5/10* (2006.01)
*E03D 1/34* (2006.01)

(52) U.S. Cl.
CPC ..... *E03D 5/105* (2013.01); *E03D 1/34* (2013.01)

(58) Field of Classification Search
CPC ..... E03D 5/105; E03D 5/34
USPC ..... 4/406, 407
See application file for complete search history.

(56) References Cited

U.S. PATENT DOCUMENTS

| | | | | |
|---|---|---|---|---|
| 8,370,969 | B2 * | 2/2013 | Bowcutt | E03D 11/00 4/313 |
| 2014/0123378 | A1 * | 5/2014 | Luettgen | B23P 19/00 4/406 |
| 2015/0074893 | A1 * | 3/2015 | Veros | E03D 5/105 4/313 |
| 2016/0208471 | A1 * | 7/2016 | Yu | E03D 1/35 |

* cited by examiner

*Primary Examiner* — Huyen Le
(74) *Attorney, Agent, or Firm* — Rabin & Berdo, P.C.

(57) ABSTRACT

A drain valve device based on capacitive sensing for a water tank of a toilet includes a drain valve disposed in the water tank of the toilet to control the water tank to drain water; a capacitive sensing control module that opens the drain valve; and an assembly fixture used to connect the capacitive sensing control module to the drain valve to make the capacitive control module and the drain valve form an integration. The assembly fixture connects the capacitive sensing control module and the drain vale to form the integration, so that during assembly of the drain valve, the capacitive sensing control module is affixed to the toilet water tank at the same time. Thus, assembly is simple and convenient, and there is no need to dispose an assembly hole in the water tank cover so the structure is simpler.

12 Claims, 6 Drawing Sheets

TOILET TANK DRIVE VALVE DEVICE BASED ON CAPACITIVE SENSING

FIELD OF THE INVENTION

The present invention relates to a drain valve device of the toilet water tank, especially to a drain valve device based on capacitive sensing.

BACKGROUND OF THE INVENTION

The drain valve used in the ceramic toilet water tank in the existing market is usually coupled a button or a sensing window of the water tank cover to form a mechanical type, hydraulic type, sensing type or air control drain valve, the drain valves are needed to connect to the button or the sensing component in other places, such as in the water tank cover, by pushing bars or electric wires or pipes, when assembling, it needs to assemble the button or the sensing component after the drain valve is assembled. Therefore, existing drain valves has some defects: firstly, the drain valve and the button or sensing component need to be assembled separately, the assembly is complicated and inconvenient; secondly, for a sensing type drain valve, the electric wires are exposed out of the structure and located in the water tank, it goes against the water proof performance.

There are proposal that the sensing control portion to open the drain valve is hanging to the ceramic wall of the water tank, a motor is used to drive the chain to lift the flapper up so as to achieve drainage. However, different ceramic water tank have different wall thickness, not all sensing control component can be hung to the wall, so that it is not suitable for all; besides, as different water tanks have different height, the chain needs to be height adjusted, the assembly is complicated; and as the flapper is located at the center of the water tank, the sensing control component needs to be hung at the center, but when the flapper is open, it blocks at the front of the water tank, thus influencing the sensing operation.

SUMMARY OF THE INVENTION

The present invention is provided with a drain valve device based on capacitive sensing, which overcomes the technical problems of the existing technology, the technical proposal of the present invention is that:

A drain valve device based on capacitive sensing, comprising a drain valve disposed in the water tank of the toilet to control the water tank to drain water, wherein further comprising a capacitive sensing control module used to open the drain valve and an assembly fixture used to connect the capacitive sensing control module to the drain valve to make the capacitive control module and the drain valve form an integration.

The assembly fixture connects the capacitive sensing control module and the drain vale to form an integration, when assembling, it only needs to assemble the drain valve (it doesn't need to assemble the capacitive sensing control module separately) that it can, at the same time, fix the capacitive sensing control module to the toilet water tank, the assembly is simple and convenient. It doesn't need to dispose assembly hole in the water tank cover, the structure is simpler. Besides, the capacitive sensing control module can be located at the side of the drain valve, for example at the top left corner or the top right corner, the top portion of the water tank has nothing covered that it is convenient to sense the hand wave. Moreover, the drain valve device is suitable to various kinds of ceramic water tanks in the market, and the appearance is not changed, so that it has well applicability.

In another preferred embodiment, the drain valve device is fixedly connected to the water tank just by the drain valve.

In another preferred embodiment, the assembly fixture is disposed in an overflow pipe of the drain valve or in a housing of the drain valve. The drain valve doesn't need other fixing structure to assemble the assembly fixture, the structure is compact with well applicability.

In another preferred embodiment, the capacitive sensing control module is disposed in a closed box, the closed box is connected to the assembly fixture. The closed box can efficiently protect the capacitive sensing control module that it avoids water erosion.

In another preferred embodiment, the external portion of the closed box is disposed with a rack, the assembly fixture comprises a fasten sleeve sleeved on the overflow pipe, a connecting set connected to the side of the fasten sleeve and a stop element to limit the vertical movement of the rack, the rack vertically passes through connecting set, the stop element is movably disposed to the connecting set to alternately lock to the rack or separate from the rack. The rack movably passes through the connecting set, it removes the limit of the stop element to the rack, so that the capacitive sensing control module can be height adjusted.

In another preferred embodiment, the capacitive sensing control module comprises a capacitive sensing component to sense a hand signal from the external portion of the water tank of the toilet to form a capacity variation sensing signal, an air pump connected to the capacitive sensing component to pump air to the drain valve through an air pipe based on the capacity variation sensing signal so as to open the drain valve and a battery component to supply power to the air pump. The drain valve is controlled by air, the structure is simpler. Moreover, the air control drain valve doesn't need other button operation component, no pipe or wire is needed to connect the upper cover of the water tank and the drain valve, the structure is simple, as the air pipe keeps still, it doesn't influence other components (for example the refill pipe) of the water tank.

In another preferred embodiment, the capacitive sensing control module further comprises a sound component used to raise an alarm when the battery component is in low battery.

In another preferred embodiment, the drain valve is disposed with a pulling bar to open the water tank of the toilet, the drain valve is further disposed with an air bag connected to the air pipe, the air bag can blow up to drive the pulling bar to lift up to open the water tank of the toilet.

In another preferred embodiment, the top portion of the pulling bar is connected to one end of a pressing plate, the other end of the pressing plate is connected to a telescopic pipe, the air bag is located in the telescopic pipe.

In another preferred embodiment, a pull button is disposed at the top portion of the pressing plate. Pulling the pull button manually can drive the pulling bar to move upwardly to open the toilet tank to drain water.

In another preferred embodiment, the capacitive sensing control module opens the drain valve by pulling a chain or a cord.

A drain valve device based on capacitive sensing, comprising a drain valve disposed in the water tank of the toilet to control the water tank to drain water, wherein further comprising a capacitive sensing control module to open the drain valve, the capacitive sensing control module comprises a capacitive sensing component to sense a hand signal from the external portion of the water tank of the toilet to form a capacity variation sensing signal, an air pump connected to the capacitive sensing component to pump air to the drain valve through an air pipe based on the capacity variation sensing signal so as to open the drain valve and a battery component to supply power to the air pump.

Moreover, the air control drain valve doesn't need other button operation component, no pipe or wire is needed to connect the upper cover of the water tank and the drain valve, the structure is simple, as the air pipe keeps still, it doesn't influence other components (for example the refill pipe) of the water tank.

In another preferred embodiment, the drain valve is disposed with a pulling bar to open the water tank of the toilet, the drain valve is further disposed with an air bag connected to the air pipe, the air bag can blow up to drive the pulling bar to lift up to open the water tank of the toilet.

In another preferred embodiment, the top portion of the pulling bar is connected to one end of a pressing plate, the other end of the pressing plate is connected to a telescopic pipe, the air bag is located in the telescopic pipe.

In another preferred embodiment, a pull button is disposed at the top portion of the pressing plate.

In another preferred embodiment, an assembly fixture is further disposed to connect the capacitive sensing control module to the drain valve to make the capacitive control module and the drain valve form an integration.

In another preferred embodiment, the assembly fixture is disposed in an overflow pipe of the drain valve or in a housing of the drain valve.

In another preferred embodiment, the capacitive sensing control module is disposed in a closed box, the external portion of the closed box is disposed with a rack, the assembly fixture comprises a fasten sleeve sleeved on the overflow pipe, a connecting set connected to the side of the fasten sleeve and a stop element to limit the vertical movement of the rack, the rack vertically passes through connecting set, the stop element is movably disposed to the connecting set to alternately lock to the rack or separate from the rack.

A drain valve device based on capacitive sensing, comprising a drain valve disposed in the water tank of the toilet to control the water tank to drain water, wherein further comprising a capacitive sensing control module used to open the drain valve and an assembly fixture used to connect the capacitive sensing control module to the drain valve to make the capacitive control module and the drain valve form an integration, the capacitive sensing control module comprises a capacitive sensing component to sense a hand signal from the external portion of the water tank of the toilet to form a capacity variation sensing signal, an air pump connected to the capacitive sensing component to pump air to the drain valve through an air pipe based on the capacity variation sensing signal so as to open the drain valve and a battery component to supply power to the air pump.

In another preferred embodiment, the drain valve is disposed with a pulling bar to open the water tank of the toilet, the drain valve is further disposed with an air bag connected to the air pipe, the air bag can blow up to drive the pulling bar to lift up to open the water tank of the toilet.

In another preferred embodiment, the top portion of the pulling bar is connected to one end of a pressing plate, the other end of the pressing plate is connected to a telescopic pipe, the air bag is located in the telescopic pipe.

In another preferred embodiment, the assembly fixture is disposed in an overflow pipe of the drain valve or in a housing of the drain valve.

In another preferred embodiment, the capacitive sensing control module is disposed in a closed box, the external portion of the closed box is disposed with a rack, the assembly fixture comprises a fasten sleeve sleeved on the overflow pipe, a connecting set connected to the side of the fasten sleeve and a stop element to limit the vertical movement of the rack, the rack vertically passes through connecting set, the stop element is movably disposed to the connecting set to alternately lock to the rack or separate from the rack.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
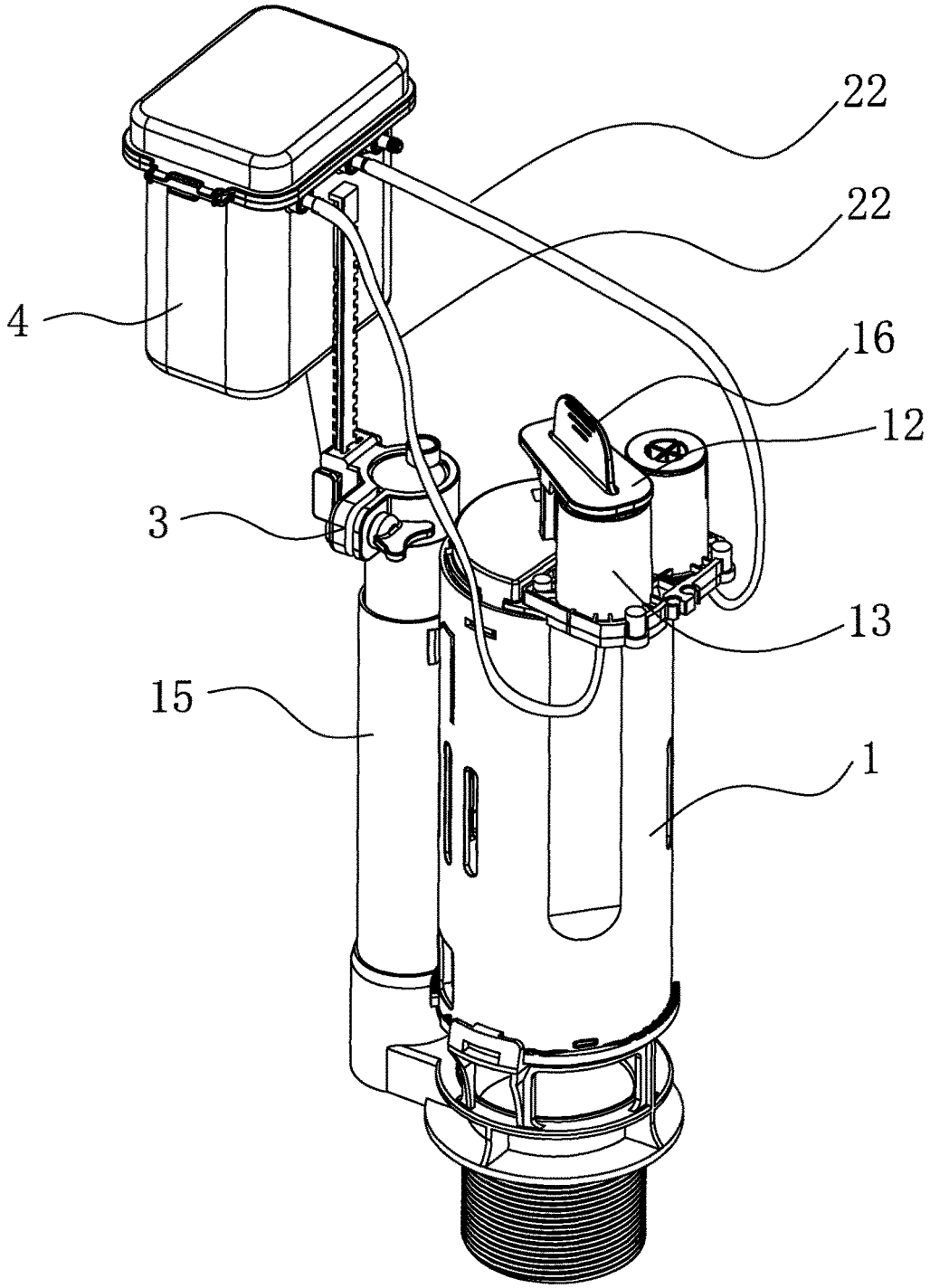
FIG. 1 illustrates a schematic diagram of a drain valve device of a first embodiment of the present invention.
Figure 2:
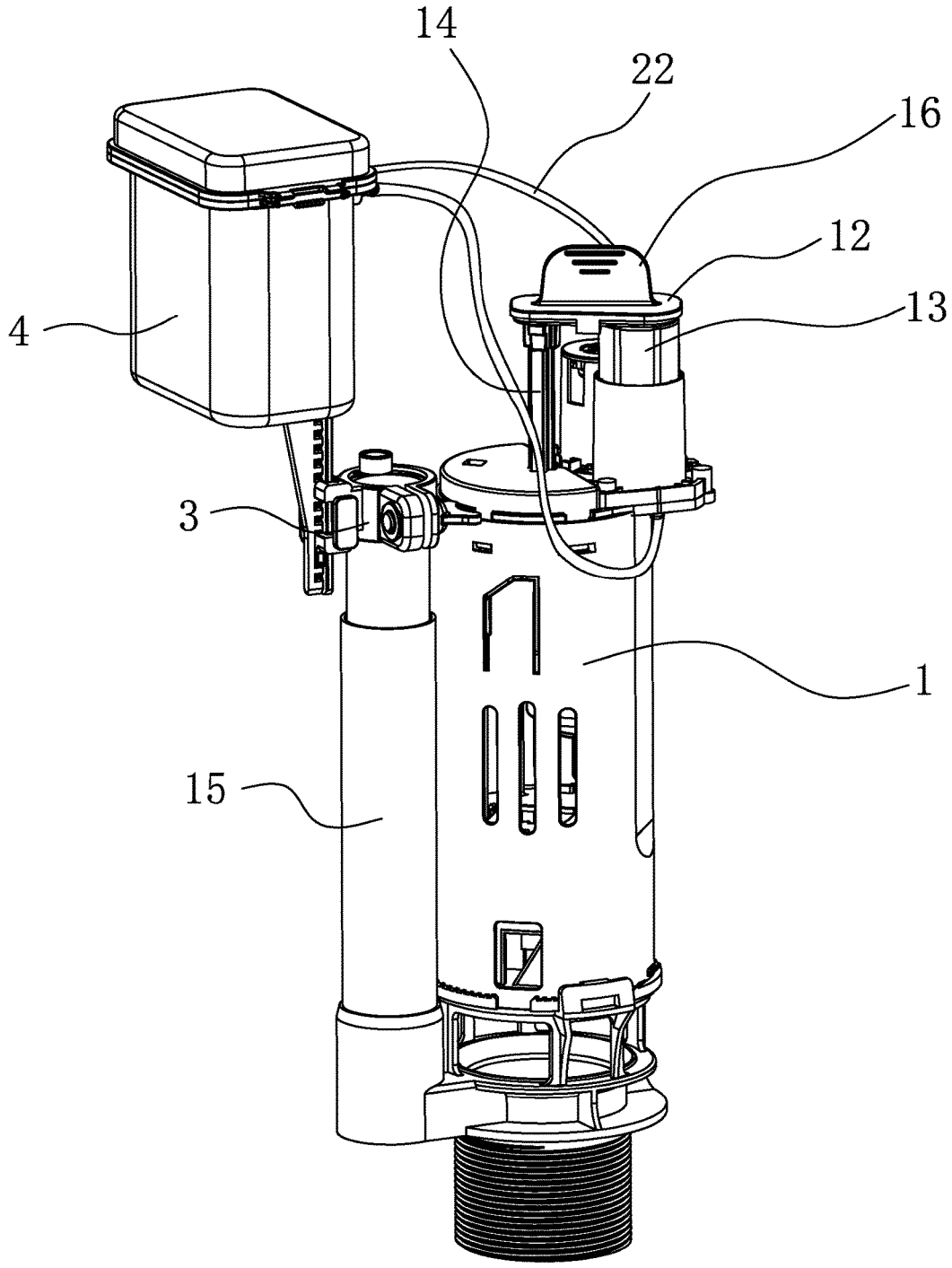
FIG. 2 illustrates a schematic diagram of the drain valve device of FIG. 1 when the water tank drains water.
Figure 3:
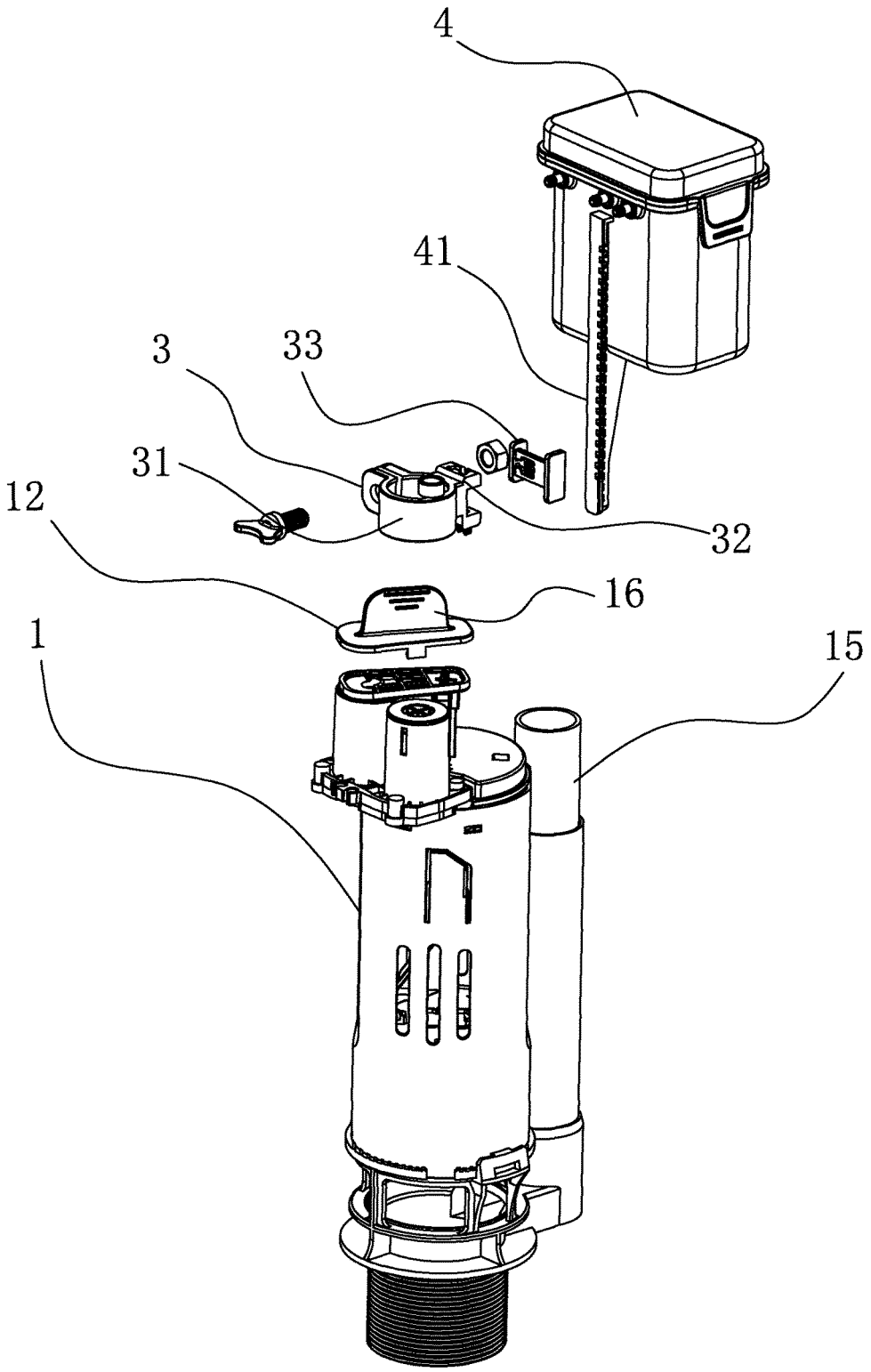
FIG. 3 illustrates an exploded diagram of the assembly fixture of the drain valve device of FIG. 1.
Figure 4:
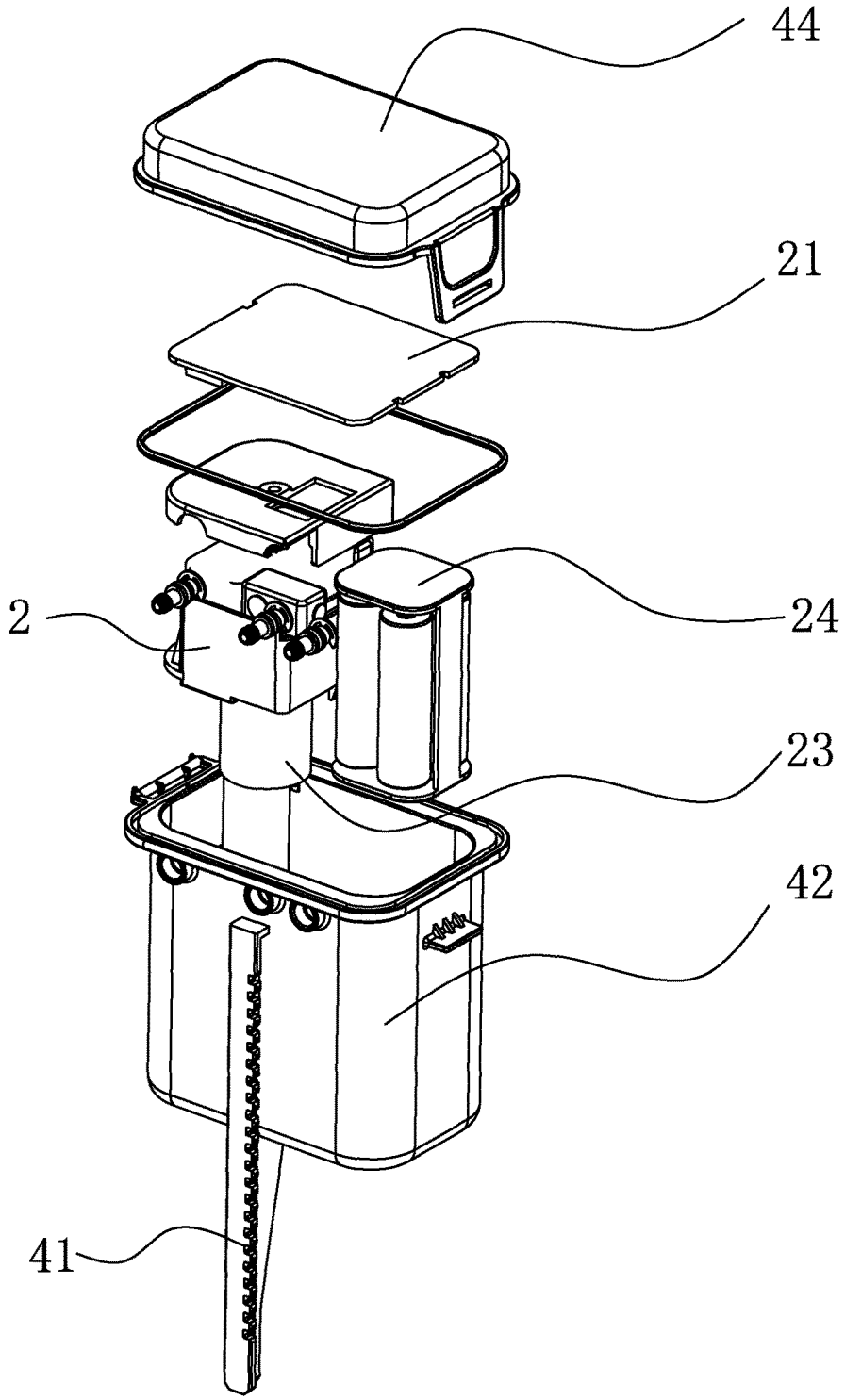
FIG. 4 illustrates an exploded diagram of the capacitive sensing control module of the drain valve device of FIG. 1.
Figure 5:
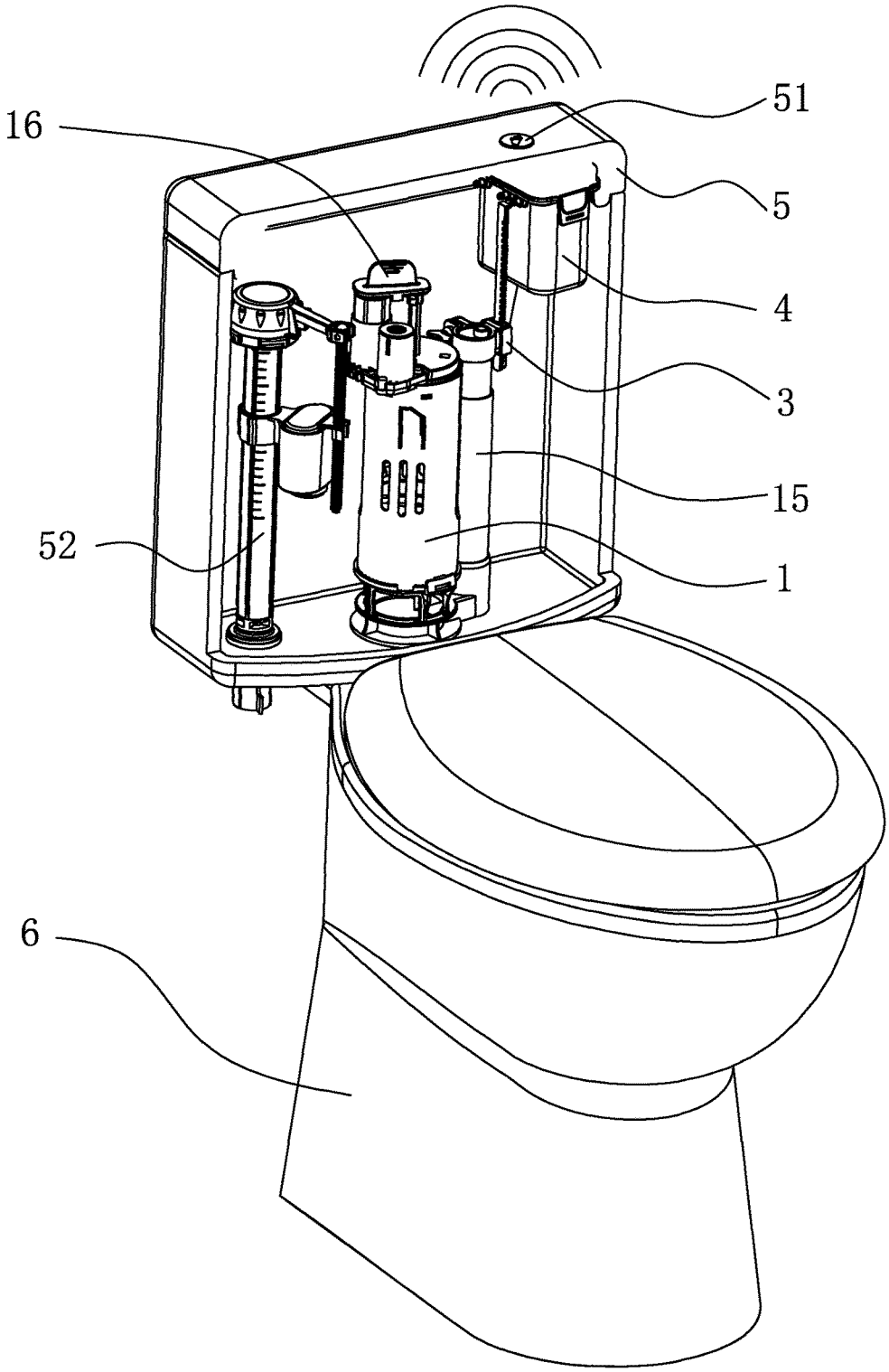
FIG. 5 illustrates a schematic diagram of the drain valve device of FIG. 1 assembled to the toilet water tank.

Referring to FIGS. 1-5, the drain valve device based on capacitive sensing comprises a drain valve 1 disposed in the toilet water tank 5 to control the water tank 5 to flush the toilet bowl 6; a capacitive sensing control module 2 used to open the drain valve 1, the capacitive sensing control module 2 is disposed in a closed box 4; an assembly fixture used to connect the capacitive sensing control module 2 to the drain valve 1, the closed box 4 is connected to the assembly fixture 3.

The drain valve 1 is an air control drain valve, the drain valve 1 is disposed with a pulling bar 14 used to open the toilet water tank 5, the top portion of the pulling bar 14 is connected to one end of a pressing plate 12, the other end of the pressing plate 12 is connected to a telescopic pipe 13, both ends of which are respectively connected to the pressing plate 12 and the housing of the drain valve 1. The drain valve 1 is further disposed with an air bag located in the telescopic pipe 13, the air bag can blow up to drive the pulling bar 14 to lift up to open the water tank 5, the size of the blew air bag decides the extending length of the telescopic pipe 13 to control the direction of the pulling bar moving upwardly, thus controlling high and low drainage volume of the toilet water tank 5. The top portion of the pressing plate 12 is disposed with a pull button 16. The side portion of the drain valve 1 is further disposed with an overflow pipe 15.

The closed box 4 has a box body 42 and a box cover 44, the external portion of the box body 42 is vertically disposed with a rack 41. The assembly fixture 3 comprises a fasten sleeve 31 sleeved on the overflow pipe 15 of the drain valve 1, a connecting set 32 connected to the side of the fasten sleeve 31 and a stop element 33 used to limit the vertical movement of the rack 41. the rack 41 vertically passes through the connecting set 32, the stop element 33 is movably connected to the connecting set 32 to alternatively lock to the rack 41 and separate from the rack 41, the movement direction of the stop element 33 is vertical to the rack 41. when pressing the stop element 33 in a first direction, the stop element 33 separates from the rack 41, when pressing the stop element 33 in a second direction, the stop element 33 is locked to the rack 41.

The capacitive sensing control module 2 comprises a capacitive sensing component 21 to sense a hand signal from the external portion of the water tank 5 of the toilet to form a capacity variation sensing signal, an air pump 23 connected to the capacitive sensing component 21 to pump air to the drain valve 1 through an air pipe 22 based on the capacity variation sensing signal so as to open the drain valve 1, a battery component 24 to supply power to the air pump 23 and a sound component used to raise an alarm when the battery component 24 is in low battery. The box cover 44 can be open to change the battery of the battery component 24.

The drain valve device is provided as an integration, when assembling, the drain valve device is fixedly connected to the toilet water tank 5 only just by the drain valve 1, the drain valve device is wholly disposed in the toilet water tank 5, the capacitive sensing control module 2 in the closed box 4 and the inlet valve 52 of the toilet water tank 5 are respectively disposed at the left and right side of the drain valve 1, there is no shelter above the capacitive sensing control module 2 at the external portion of the toilet water tank 5, so that no effect exists to the hand wave operation. When used, people put a hand on the external portion of the toilet water tank 5, once the capacitive sensing control module 2 detects the period of the hand wave motion and forms a capacity variation sensing signal, the air pump 23 pumps a certain volume of air to the air bag of the drain valve 1 through the air pipe 22 according to the indication of the capacity variation sensing signal, then the air bag blows up to drive the pulling bar to lift up to drain water in high or low volume. Preferred, an indicator 51 can be attached on the toilet water tank corresponding to the capacitive sensing control module 2.

The Second Embodiment

Figure 6:
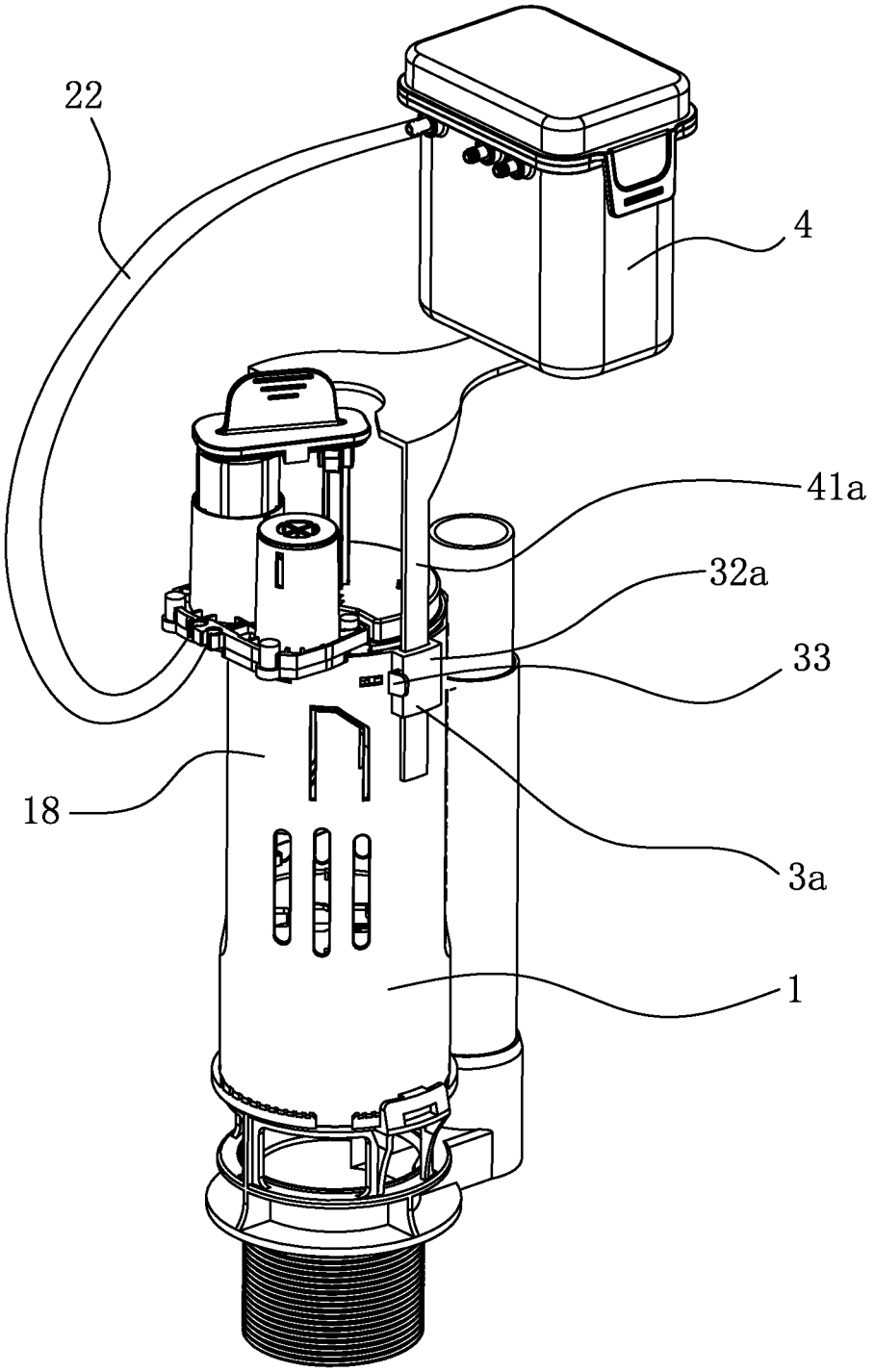
FIG. 6 illustrates a schematic diagram of a drain valve device of a second embodiment of the present invention.

Referring to FIG. 6, the drain valve device of the second embodiment differs from the first embodiment in that: the assembly fixture is connected to the housing 18 of the drain valve 1, the assembly fixture comprises a connecting set 32*a* integratedly formed with the housing 18, a stop element 33 used to limit the vertical movement of the rack 41*a*. The rack 41*a* vertically passes through the connecting set 32*a*, the stop element 33 is movably connected to the connecting set 32*a* to alternately locked to the rack 41*a* and separate from the rack 41*a*.

It should be noted that, the drain valve can be applied with a mechanical drain valve, when the capacitive sensing control module detects a hand signal, it drives the motor to work, the drain valve drains water by pulling a chain or a cord.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A drain valve device based on capacitive sensing for a water tank of a toilet, comprising:

a drain valve disposed in the water tank of the toilet to control the water tank to drain water;

a capacitive sensing control module that opens the drain valve and that comprises:

a capacitive sensing component to sense a hand signal from the external portion of the water tank of the toilet to form a capacity variation sensing signal;

an air pump connected to the capacitive sensing component to pump air to the drain valve through an air pipe based on the capacity variation sensing signal to open the drain valve; and a battery component to supply power to the air pump.

2. The drain valve device based on capacitive sensing according to claim 1, wherein the drain valve is disposed with a pulling bar to open the water tank of the toilet, and an air bag connected to the air pipe that inflates to drive the pulling bar to lift up to open the water tank of the toilet.

3. The drain valve device based on capacitive sensing according to claim 2, wherein the pulling bar has a top portion that is connected to one end of a pressing plate, another end of the pressing plate is connected to a telescopic pipe, and the air bag is located in the telescopic pipe.

4. The drain valve device based on capacitive sensing according to claim 3, wherein a pull button is disposed at the top portion of the pressing plate.

5. The drain valve device based on capacitive sensing according to claim 1, wherein an assembly fixture is further disposed to connect the capacitive sensing control module to the drain valve to make the capacitive control module and the drain valve form an integration.

6. The drain valve device based on capacitive sensing according to claim 5, wherein the drain valve has an overflow pipe and a housing, and wherein the assembly fixture is disposed in the overflow pipe of the drain valve or in the housing of the drain valve.

7. The drain valve device based on capacitive sensing according to claim 6, wherein the capacitive sensing control module is disposed in a closed box and the external portion of the closed box is disposed with a rack, wherein the assembly fixture comprises:

a fasten sleeve sleeved on the overflow pipe;

a connecting set connected to the side of the fasten sleeve; and a stop element to limit the vertical movement of the rack; and wherein the rack vertically passes through the connecting set, and the stop element is movably disposed to the connecting set to alternately lock to the rack or separate from the rack.

8. A drain valve device based on capacitive sensing for a water tank of a toilet, comprising:

a drain valve disposed in the water tank of the toilet to control the water tank to drain water;

a capacitive sensing control module that opens the drain valve; and an assembly fixture used to connect the capacitive sensing control module to the drain valve to make the capacitive control module and the drain valve form an integration, wherein the capacitive sensing control module comprises:

a capacitive sensing component to sense a hand signal from the external portion of the water tank of the toilet to form a capacity variation sensing signal;

an air pump connected to the capacitive sensing component to pump air to the drain valve through an air pipe based on the capacity variation sensing signal to open the drain valve; and a battery component to supply power to the air pump.

9. The drain valve device based on capacitive sensing according to claim 8, wherein the drain valve is disposed with a pulling bar to open the water tank of the toilet, and an air bag connected to the air pipe that inflates to drive the pulling bar to lift up to open the water tank of the toilet.

10. The drain valve device based on capacitive sensing according to claim 9, wherein the pulling bar has a top portion that is connected to one end of a pressing plate, another end of the pressing plate is connected to a telescopic pipe, and the air bag is located in the telescopic pipe.

11. The drain valve device based on capacitive sensing according to claim 8, wherein the drain valve has an overflow pipe and a housing, and wherein the assembly fixture is disposed in the overflow pipe of the drain valve or in the housing of the drain valve.

12. The drain valve device based on capacitive sensing according to claim 11, wherein the capacitive sensing control module is disposed in a closed box and the external portion of the closed box is disposed with a rack, wherein the assembly fixture comprises:

a fasten sleeve sleeved on the overflow pipe;

a connecting set connected to the side of the fasten sleeve; and a stop element to limit the vertical movement of the rack; and wherein the rack vertically passes through the connecting set, and the stop element is movably disposed to the connecting set to alternately lock to the rack or separate from the rack.

* * * * *